US005582808A

United States Patent [19]

Patek

[11] Patent Number: 5,582,808

[45] Date of Patent: Dec. 10, 1996

[54] BOROHYDRIDES TO INHIBIT POLYMER FORMATION IN PETROCHEMICAL CAUSTIC SCRUBBERS

[75] Inventor: Gary Patek, Katy, Tex.

[73] Assignee: Baker Hughes Incorporated, Houston, Tex.

[21] Appl. No.: 435,858

[22] Filed: May 5, 1995

[51] Int. Cl.[6] ..... C01D 7/00

[52] U.S. Cl. ..... 423/210; 526/74; 526/196; 585/532; 585/853; 208/48 AA

[58] Field of Search ..... 423/210; 526/74, 526/196; 585/832, 853; 208/48 AA

[56] References Cited

U.S. PATENT DOCUMENTS

| | | | |
|---|---|---|---|
| 2,909,486 | 10/1959 | Colichman | 252/74 |
| 3,130,148 | 4/1964 | Gleim | 208/189 |
| 3,230,225 | 1/1966 | Arrigo | 260/290 |
| 3,380,960 | 4/1968 | Ebner | 260/666.5 |
| 3,396,154 | 8/1968 | Chamberlin et al. | 260/85.5 |
| 3,737,475 | 6/1973 | Mason | 260/683.15 |
| 3,769,268 | 10/1973 | George | 260/89.5 |
| 3,914,205 | 10/1975 | Gorecki et al. | 527/300 |
| 3,989,740 | 11/1976 | Broussard et al. | 260/486 R |
| 4,085,267 | 4/1978 | Morningstar et al. | 526/74 |
| 4,269,954 | 5/1981 | Morningstar et al. | 526/62 |
| 4,376,850 | 3/1983 | Sanner | 526/196 |
| 4,439,311 | 3/1984 | O'Blasny | 208/179 |
| 4,504,383 | 3/1985 | O'Blasny | 208/179 |
| 4,536,236 | 8/1985 | Haas . | |
| 4,585,579 | 4/1986 | Bommaraju et al. | 252/387 |
| 4,673,489 | 6/1987 | Roling | 208/289 |
| 4,952,301 | 8/1990 | Awbrey | 208/48 AA |
| 5,160,425 | 11/1992 | Lewis | 208/95 |
| 5,194,143 | 3/1993 | Roling | 208/291 |
| 5,197,996 | 3/1993 | Reid et al. | 44/317 |
| 5,220,104 | 6/1993 | McDaniel et al. | 585/853 |
| 5,264,114 | 11/1993 | Dunbar | 208/48 |
| 5,288,394 | 2/1994 | Lewis et al. | 208/48 AA |

FOREIGN PATENT DOCUMENTS

| | | |
|---|---|---|
| 612705A1 | 8/1994 | European Pat. Off. . |

OTHER PUBLICATIONS

Sodium Borohydride Digest, Morton, pp. 1–10.
PSP Patent Bibliography 1955–1979, Process Stream Purification.
Synthetic High Polymers, vol. 119, 1993, p. 25.
Herbert O. House, Modern Synthetic Reactions, 2nd edt., 1972, pp. 45–53, 71–73.
Jerry March, Advanced Organic Chemistry, 2nd edt., 1977, pp. 829–833, 1116–1118.

*Primary Examiner*—Michael Lewis
*Assistant Examiner*—Amy M. Harding
*Attorney, Agent, or Firm*—Rosenblatt & Redano, P.C.

[57] ABSTRACT

The present invention provides borohydrides that are useful in reducing aldol condensation and subsequent polymer formation in caustic scrubbers. The borohydrides are believed to react with reactive carbonyls yielding more stable alcohols and a salt of the borohydride which remains water soluble, and thus is unlikely to be carried out with the hydrocarbon phase. The borohydrides of the present invention have the potential to reduce reactive carbonyls at a molar ratio as high as about 4:1::carbonyl:borohydride. A preferred borohydride is sodium borohydride (sodium tetrahydroborate).

19 Claims, No Drawings

BOROHYDRIDES TO INHIBIT POLYMER FORMATION IN PETROCHEMICAL CAUSTIC SCRUBBERS

FIELD OF THE INVENTION

The present invention relates to the use of borohydrides to reduce aldehydes and certain ketones to unreactive alcohols in petrochemical caustic scrubbers, resulting in a reduction of aldol condensation and subsequent polymer formation in these scrubbers. A preferred borohydride is sodium borohydride (sodium tetrahydroborate).

BACKGROUND OF THE INVENTION

Refineries employ atmospheric and vacuum distillation towers to separate crude oil into narrower boiling fractions. These fractions then are converted into fuel products, such as motor gasoline, distillate fuels (diesel and heating oils), and bunker (residual) fuel oils. Some of the low boiling fractions from various units of the refinery are directed to petrochemical plants, where they are further processed into highly refined chemical feedstocks to be used as raw materials in the manufacture of other types of products, such as plastics and basic chemicals.

Within the petrochemical plant, processing of low boiling, mixed olefin streams primarily derived from pyrolytic cracking of hydrocarbons often require that the stream be treated in a caustic scrubber to remove acid gases, such as hydrogen sulfide and carbon dioxide. A caustic scrubber is a vessel containing an aqueous solution of caustic (NaOH, KOH, etc.) through which liquid or gaseous hydrocarbons are passed and mixed to wash out or "scrub out" the acid gases and impurities from the hydrocarbon stream. The hydrocarbon stream entering the caustic scrubber also may contain aldehydes and ketones, their precursors, such as vinyl acetate, or other impurities, that are hydrolyzed or otherwise converted to aldehydes and salts of organic acids in the highly alkaline environment of a caustic scrubber. Such compounds will herein be referred to as "reactive compounds." These reactive compounds either (a) contain carbonics, or (b) form carbonyls under highly alkaline conditions, that are susceptible to classic aldol condensation reactions. Carbonyls that are susceptible to classic aldol condensation reactions hereinafter will be referred to as "reactive carbonyls."

Under highly alkaline conditions, lower molecular weight aldehydes, such as propionaldehyde (propanal) and especially acetaldehyde (ethanal), readily undergo base catalyzed aldol condensation at ambient temperatures. The result is the formation of oligomers and polymers which precipitate out of the scrubbing solution as viscous oils, polymeric gums, and solids. These precipitates can foul the processing equipment and result in the reduction of processing throughput and costly equipment maintenance or repair.

In the past, organic reducing agents or organic and inorganic oxidizing agents have been proposed to prevent such polymerization. These organic agents might successfully retard polymerization in caustic scrubbers; however, the organic agents also tend to undergo other reactions which can reduce their effectiveness as aldol condensation inhibitors. Also, most of the oxidizing and reducing agents in current use only react with reactive carbonyls at a molar ratio of about 1:1 at maximum efficiency. A fewer number of these compounds can only reduce a maximum theoretical ratio of 2 moles of a reactive carbonyl per mole of the inhibitor compound. As a result, a relatively large amount of oxidizing or reducing agent must be added to retard polymerization.

A more effective and economical method of retarding aldol condensation in caustic scrubbers would be highly desirable.

SUMMARY OF THE INVENTION

The present invention provides borohydrides that are useful in reducing aldol condensation and subsequent polymer formation in caustic scrubbers. The borohydrides are believed to react with reactive carbonyls, yielding more stable alcohols and a salt of the borohydride which remains water soluble, and thus is unlikely to be carried out with the hydrocarbon phase. The borohydrides of the present invention have the potential to reduce reactive carbonyls at a molar ratio as high as about 4:1::carbonyl:borohydride. A preferred borohydride is sodium borohydride (sodium tetrahydroborate).

DETAILED DESCRIPTION OF THE INVENTION

The present invention is directed to reactions that cause fouling in caustic scrubbers. Exemplary product streams for use in accordance with the present invention include mixed light olefins, such as ethylene, propylene, butylene, etc., resulting from pyrolytically cracked mixtures of aliphatic hydrocarbons, such as ethane, propane, butane, and naphtha. Without limiting the present invention, it is believed that the red precipitate that forms in caustic scrubbers is the result of several aldol condensation/dehydration steps. As used herein, the term "aldol condensation" is intended to refer to the reactions that ultimately result in the formation of a precipitate in caustic scrubbers. The borohydrides of the present invention are believed to inhibit fouling by inhibiting such aldol condensation.

Substantially any borohydride should function in the present invention. Preferably, the borohydride should be reactive enough to reduce the reactive carbonyls in the stream, but not reactive enough to reduce other functional groups in the stream as well. The borohydrides may have the following structure:

$$M^{+-}BH_x(OR^1)_{4-x}$$

wherein x is between about 1–4; M is selected from the group consisting of an alkali element, a tetraalkylammonium ion or quaternary amine having the structure $R^2{}_4N^+$ wherein $R^2$ is independently selected from an alkyl group having between about 1–10 carbon atoms; and, $R^1$ is independently selected from an alkyl group having between about 1–10 carbon atoms. Preferred alkali metals are Li, Na, and K.

Examples of suitable borohydrides include the following:

| | |
|---|---|
| $LiBH_4$ | lithium borohydride |
| $KBH_4$ | potassium borohydride |
| $NaBH_4$ | sodium borohydride |
| $(CH_3)_4NBH_4$ | tetramethylammonium borohydride |
| $(C_2H_5)_4NBH_4$ | tetraethylammonium borohydride |
| $NaBH[OCH(CH_3)_2]_3$ | sodium triisopropoxyborohydride |

Preferred borohydrides are soluble in hydroxylic solvents such as low molecular weight alcohols or water, of this group, sodium borohydride is preferred. Sodium borohydride is commonly available in powder form under the name VENPURE POWDER® from Morton Performance Chemicals, Danvers, Mass. Cyanoborohydrides are not preferred because they are ineffective in highly alkaline solutions.

Although aluminum hydrides should reduce reactive carbonyls, and thus should function in the present invention, aluminum hydrides are very potent reducing agents which tend to react with other functional groups besides reactive carbonyls. Furthermore, the reactivity of aluminum hydrides prohibits dilution using a hydroxylic solvent, such as an alcohol or water, as a delivery vehicle for injection into the caustic scrubber. A non-hydroxylic solvent, such as toluene or hexane, may be used, but is not as desirable. Furthermore, aluminum hydrides tend to react with the water in a caustic solution. Therefore, aluminum hydrides may function, but are not preferred for use in the present invention. As used herein, the term "hydrides" refers to borohydrides and aluminum hydrides.

In general, borohydrides have the potential to reduce a molar concentration of reactive carbonyl compounds that is equal to the number of active hydrogens in the hydride compound. For example, $NaBH_4$ should reduce four moles of a carbonyl compound at maximum efficiency, while $NaBH[OCH(CH_3)_2]_3$ is capable of reducing only one mole of a carbonyl compound.

Preferably, the borohydride should be introduced into a caustic solution at a rate (if a continuous process) or in an amount (if a batch washing process) to assure that the proper stoichiometric concentration of the borohydride is, at least, equal to or slightly exceeds the molar concentration of all reactive carbonyls present in the caustic solution. Sodium borohydride will inhibit aldol condensation in the caustic scrubber at ambient temperatures.

The reactive carbonyl content in the caustic solution may be determined using known analytical techniques (such as spectrophotometric measurements using 2,4-dinitrophenylhydrazine) following neutralization of the caustic solution. The concentration of the borohydride added to the caustic solution may be monitored by plasma emission spectroscopy for boron. In principle, certain analytical methods may be employed on the caustic scrubber solution to measure trace amounts of active, unreacted borohydride.

Typically, caustic solutions in which aldol condensation occurs will change from colorless solutions to yellow, orange, then red or brown solutions. The color change normally precedes polymer formation. Thus, in the absence of any analytical results for a caustic scrubber solution, the aldol condensation inhibitor should be added at a rate or in an amount, at least, to prevent formation of polymer, but preferably, to prevent further changes or intensification of color in the caustic wash solution.

For maximum effectiveness, sodium borohydride may be stabilized against hydrolysis during storage. This can be accomplished in an aqueous or alcoholic solution by maintaining the reaction solution at high alkalinity, preferably at a pH approaching 14, preferably using a quaternary ammonium hydroxide or an alkali metal hydroxide. Generally, the concentration of the sodium borohydride should be between about 0.01%–20% by weight of the alkaline stabilized solution. Caustic (NaOH) solutions at approximately 1 molar concentration may be employed as stabilization solutions for sodium borohydride. A stabilized water solution of 12% sodium borohydride in caustic soda as VENPURE® solution is also available from Morton Performance Chemicals, Danvers, Mass. The stabilized solution of sodium borohydride may be metered into the caustic scrubber units as needed.

The invention will be more clearly understood with reference to the following examples.

Example 1

25.0 ml of NaOH and 32,000 ppm of $NaBH_4$, by weight of the final solution, were placed in a two ounce sample bottle, and 100 μl of vinyl acetate was injected into the solution. In a similarly prepared sample bottle lacking the $NaBH_4$ inhibitor, the vinyl acetate hydrolyzed to give acetaldehyde which, in turn, formed a red precipitate in about one hour from multiple aldol condensations. The $NaBH_4$ treated solution remained clear and formed no sediment.

Example 2

Vinyl acetate was dispensed into representative scrubber solutions (100 μl per 25 ml 10% NaOH) predosed with $NaBH_4$ at 1.1 mole per 1.0 mole of vinyl acetate. The solutions were stored overnight at room temperature. $NaBH_4$ successfully inhibited both polymer and color formation. Without $NaBH_4$, yellow hazy solutions developed with a red precipitate.

Example 3

Into a clear glass bottle, labelled "A," were placed equal volumes of two solutions:

1 part 10% (w) NaOH(aq) solution, 1 part 0.020M acetaldehyde solution in water.

The resulting solution yielded a 0.010M acetaldehyde solution in a 5.26% (w) NaOH(aq) solution. (This is approximately equal to 400 ppm-w acetaldehyde in the caustic solution.) After 30 minutes, the solution changed from clear and colorless to clear but yellow. After approximately four hours, the yellow solution became hazy. On the following day (30 hours after mixing), an orange precipitate had formed and settled onto the bottom of bottle "A."

Into another bottle, labelled "G," were placed equal volumes of the following two solutions:

1 part 0.020M $NaBH_4$ in 10% (w) NaOH(aq) solution, 1 part 0.020M acetaldehyde solution in water.

As with the previous bottle, the resulting mixture in bottle "G" contained 0.010M acetaldehyde in a 5.26% (w) NaOH(aq) solution. Additionally, the solution contained 0.010M $NaBH_4$. With a molar ratio of 1:1::acetaldehyde:$NaBH_4$, solution "G" remained clear and colorless without any polymer formation.

Into bottles labelled "B" through "F" were placed aliquots of the three stock solutions resulting in mixtures which always yielded 0.010M acetaldehyde in 5.26% (w) NaOH(aq) solution, but having variable concentrations of $NaBH_4$. Table 1 summarizes the resulting combinations.

TABLE 1

| Solution | Mole Ratio of Acetaldehyde to $NaBH_4$ | Parts 0.020 M Acetaldehyde Solution | Parts 0.020 M $NaBH_4$ in 10% (w) NaOH(aq) Solution | Parts 10% (w) NaOH(aq) Solution |
|---|---|---|---|---|
| A | — | 1 | 0 | 1 |
| B | 6:1 | 1 | 1/6 | 5/6 |
| C | 5:1 | 1 | 1/5 | 4/5 |
| D | 4:1 | 1 | 1/4 | 3/4 |
| E | 3:1 | 1 | 1/3 | 2/3 |
| F | 2:1 | 1 | 1/2 | 1/2 |
| G | 1:1 | 1 | 1 | 0 |

After 30 hours at ambient temperature, the intensity of any yellow color that developed was measured with a UV/visible spectrophotometer at 425 nm. Any polymer that formed was also noted. Table 2 lists these observations.

TABLE 2

| Solution | Yellow Color Absorbance at 425 nm | Solution Description |
|---|---|---|
| A | 0.59 | Deep yellow solution with settled and suspended orange flocculent precipitate |
| B | 0.28 | Slightly hazy, yellow solution |
| C | 0.21 | clear, yellow solution with no precipitation |
| D | 0.13 | Clear, very light yellow solution with no precipitation |
| E | 0.03 | Clear, faint yellow solution with no precipitation |
| F | 0 | Clear, colorless solution with no precipitation |
| G | 0 | Clear, colorless solution with no precipitation |

The results indicate that sodium borohydride at a molar ratio of 4:1::acetaldehyde:$NaBH_4$ (sample D) inhibited polymer formation even though some color developed. At a molar ratio of 5:1::acetaldehyde:$NaBH_4$ (sample C), sodium borohydride had reduced enough acetaldehyde to retard polymer precipitation for 30 hours.

Example 4

Caustic solution taken from an actual petrochemical plant's caustic scrubber unit was vacuum filtered to remove particulate matter. The filtered caustic solution was light yellow in color. To a 2-oz. bottle were added 94 mg of a 12% (w) $NaBH_4$ solution in 1M NaOH(aq) solution, followed by 25 ml of the petrochemical plant's filtered caustic solution. (This represents 0.30 mmoles of $NaBH_4$ in the test bottle.) 100 μl (representing 1.08 mmoles) of vinyl acetate were then injected into the test bottle containing the caustic solution with the $NaBH_4$ inhibitor. The bottle was capped, shaken, then allowed to stand undisturbed for 24 hours.

1.08 mmoles of vinyl acetate is equivalent to 1.08 mmoles of acetaldehyde since vinyl acetate yields acetaldehyde following hydrolysis under alkaline conditions, as follows:

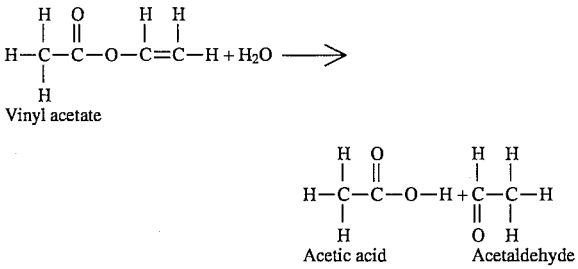

In the caustic solution, the acetic acid forms sodium acetate while the 1.08 mmoles of acetaldehyde would normally undergo the aldol condensation reaction.

At the end of 24 hours, no polymerization nor further discolorization had occurred in the treated solution. A bottle representing no treatment formed a red flocculent precipitate in a red, hazy solution. With this result, it is clear that one mole of $NaBH_4$ reduces more than one mole of reactive carbonyl compounds, in this case—3.6 moles of acetaldehyde per mole of sodium borohydride.

This example highlights two issues. First, it demonstrates sodium borohydride's potency for reducing nearly its theoretical maximum of 4 moles of reactive carbonyl compounds which would otherwise form oligomers and polymers by base catalyzed aldol condensation. Second, the caustic solution is taken from an actual caustic scrubber unit. Any impurities which it might contain did not deactivate sodium borohydride's performance.

Persons of skill in the art will appreciate that many modifications may be made to the embodiments described herein without departing from the spirit of the present invention. Accordingly, the embodiments described herein are illustrative only and are not intended to limit the scope of the present invention.

I claim:

1. A method for reducing aldol condensation and subsequent polymer formation during caustic scrubbing of a hydrocarbon stream comprising the step of treating a caustic scrubbing solution with a hydride in an amount sufficient to inhibit aldol condensation in said caustic solution but insufficient to interfere with said caustic scrubbing, wherein said hydride comprises a borohydride of the following structure:

$$M^{+}BH_x(OR^1)_{4-x}$$

wherein

M is selected from the group consisting of an alkali element, a tetraalkylammonium ion or quaternary amine having the structure $R^2{}_4N^+$ wherein $R^2$ is independently selected from an alkyl group having between 1–10 carbon atoms;

B comprises boron;

x is between about 1–4; and $R^1$ is independently selected from an alkyl group having between about 1–10 carbon atoms.

2. The method of claim 1 wherein said hydride has the following structure:

$$M^{+-}AlH_x(OR^1)_{4-x}$$

wherein

M is selected from the group consisting of an alkali element, a tetraalkylammonium ion or quaternary amine having the structure $R_{24}N^+$ wherein $R^2$ is independently selected from an alkyl group having between about 1–10 carbon atoms;

Al comprises aluminum;

x is between about 1–4; and $R^1$ is independently selected from an alkyl group having between about 1–10 carbon atoms.

3. The method of claim 1 wherein said borohydride is selected from the group consisting of sodium borohydride, lithium borohydride, potassium borohydride, tetramethylammonium borohydride, tetraethylammonium borohydride, and sodium triisopropoxyborohydride.

4. The method of claim 3 wherein said borohydride solution is maintained at a pH of about 14 before said treatment step.

5. The method of claim 3 wherein reactive carbonyls are present in said caustic solution at a molar concentration, and wherein said sufficient amount of said borohydride is at least about 25% of said molar concentration of said reactive carbonyls.

6. The method of claim 1 wherein said borohydride comprises sodium borohydride.

7. The method of claim 6 wherein reactive carbonyls are present in said caustic solution at a molar concentration, and wherein said sufficient amount of said borohydride is at least about 25% of said molar concentration of said reactive carbonyls.

8. The method of claim 1 wherein said hydrocarbon stream comprises mixed light olefins derived from pyrolytically cracked mixtures of aliphatic hydrocarbons.

9. The method of claim 1 wherein said caustic scrubbing solution comprises an aqueous solution selected from the group consisting of sodium hydroxide and potassium hydroxide.

10. The method of claim 1 wherein said hydride is selected from the group consisting of an aqueous and an alcoholic borohydride solution.

11. The method of claim 10 wherein said borohydride solution is maintained highly alkaline using a compound selected from the group consisting of a quaternary ammonium hydroxide and an alkali metal hydroxide.

12. The method of claim 11 wherein said borohydride solution is maintained at a pH of about 14 before said treatment step.

13. The method of claim 1 wherein said borohydride solution is maintained at a pH of about 14 before said treatment step.

14. The method of claim 1 wherein said borohydride solution is maintained at a pH of about 14 before said treatment step.

15. The method of claim 1 wherein reactive carbonyls are present in said caustic solution at a molar concentration, and wherein said sufficient amount of said borohydride is at least about 25% of said molar concentration of said reactive carbonyls.

16. The method of claim 1 wherein reactive carbonyls are present in said caustic solution at a molar concentration, and wherein said sufficient amount of said borohydride is at least about 25% of said molar concentration of said reactive carbonyls.

17. The method of claim 16 wherein said borohydride comprises sodium borohydride.

18. A method for reducing aldol condensation and subsequent polymer formation during caustic scrubbing of a hydrocarbon stream comprising the step of treating said caustic scrubbing solution with a borohydride in an amount sufficient to reduce aldol condensation in said caustic solution but insufficient to interfere with said caustic scrubbing, wherein said borohydride has the following structure:

$$M^{+-}BH_x(OR^1)_{4-x}$$

wherein

M is selected from the group consisting of an alkali element, a tetraalkylammonium ion or quaternary amine having the structure $R^2{}_4N^+$ wherein $R^2$ is independently selected from an alkyl group having between about 1–10 carbon atoms;

B comprises boron;

x is between about 1–4; and $R^1$ is independently selected from an alkyl group having between about 1–10 carbon atoms; and, said reactive carbonyls are present in said caustic solution at a molar concentration, and wherein said sufficient amount of said borohydride is at least about 25% of said molar concentration of said reactive carbonyls.

19. A reaction mixture in a caustic scrubber comprising a molar concentration of reactive carbonyls and at least about 25% of said molar concentration of a borohydride.

* * * * *

UNITED STATES PATENT AND TRADEMARK OFFICE

CERTIFICATE OF CORRECTION

PATENT NO. : 5,582,808
DATED : Dec. 10, 1996
INVENTOR(S) : Gary Patek

It is certified that error appears in the above-indentified patent and that said Letters Patent is hereby corrected as shown below:

Column 1, line 40-41, please delete the word "carbonics" and insert therefor the word -- carbonyls --.

Column 4, lines 39-40 and lines 46-47, (if possible) please join together the hyphenated chemical designation NaOH(aq).

Please add a space and a superscript minus sign after the superscript plus sign, changing "$M^{+}BH_x(OR^1)_{4-x}$" to -- $M^{+\ -}BH_x(OR^1)_{4-x}$ --, in the following locations: column 2, line 45; claim 1, line 8 and claim 18, line 8.

Claim 2, line 3, please add a space between the superscript minus and plus sign (which run together in the printed patent), changing "$M^{+-}AlH_x(OR^1)_{4-x}$" to -- $M^{+\ -}AlH_x(OR^1)_{4-x}$ --.

Claim 2, line 7, please change $R_{24}N^+$ to -- $R^2_4N^+$ --.

UNITED STATES PATENT AND TRADEMARK OFFICE

CERTIFICATE OF CORRECTION

PATENT NO. : 5,582,808

DATED : Dec. 10, 1996

INVENTOR(S) : Gary Patek

It is certified that error appears in the above-indentified patent and that said Letters Patent is hereby corrected as shown below:

--.

Column 5, lines 42-54, please insert spaces before and after the "+" sign in the equation, and before the arrow, changing:

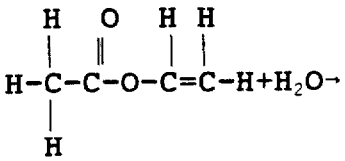

Vinyl acetate

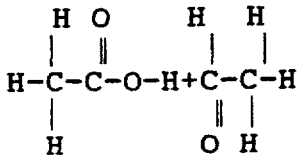

Acetic acid Acetaldehyde

UNITED STATES PATENT AND TRADEMARK OFFICE

CERTIFICATE OF CORRECTION

PATENT NO. : 5,582,808

DATED : Dec. 10, 1996

INVENTOR(S) : Gary Patek

It is certified that error appears in the above-indentified patent and that said Letters Patent is hereby corrected as shown below:

to

-- 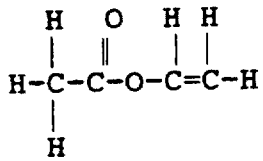

Vinyl acetate

+ $H_2O$ →

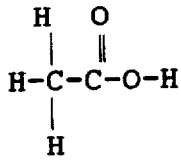

Acetic acid

+ 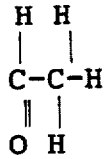

Acetaldehyde --.

Signed and Sealed this

Twenty-seventh Day of January, 1998

*Attest:*

BRUCE LEHMAN

*Attesting Officer*

*Commissioner of Patents and Trademarks*